US009675825B2

(12) United States Patent
Guo et al.

(10) Patent No.: US 9,675,825 B2
(45) Date of Patent: Jun. 13, 2017

(54) METHOD FOR EXTINGUISHING FIRE

(75) Inventors: Hongbao Guo, Xi'an (CN); Weipeng Zhang, Xi'an (CN)

(73) Assignee: Xi'an Westpeace Fire Technology Co., Ltd., Xi'an (CN)

( * ) Notice: Subject to any disclaimer, the term of this patent is extended or adjusted under 35 U.S.C. 154(b) by 0 days.

(21) Appl. No.: 13/824,282

(22) PCT Filed: Sep. 7, 2011

(86) PCT No.: PCT/CN2011/079423

§ 371 (c)(1),
(2), (4) Date: Mar. 15, 2013

(87) PCT Pub. No.: WO2012/034489

PCT Pub. Date: Mar. 22, 2012

(65) Prior Publication Data

US 2013/0175060 A1 Jul. 11, 2013

(30) Foreign Application Priority Data

Sep. 16, 2010 (CN) ..... 2010 1 0285541

(51) Int. Cl.
*A62C 5/00* (2006.01)
*A62D 1/06* (2006.01)

(52) U.S. Cl.
CPC ..... *A62C 5/006* (2013.01); *A62D 1/06* (2013.01)

(58) Field of Classification Search
CPC ..... A62C 5/006; A62D 1/06
(Continued)

(56) References Cited

U.S. PATENT DOCUMENTS 4,183,822 A * 1/1980 Collington et al. ..... 516/11
4,961,865 A * 10/1990 Pennartz ..... 252/7
(Continued)

FOREIGN PATENT DOCUMENTS

CN 1481266 A 3/2004
CN 1713935 A 12/2005
(Continued)

OTHER PUBLICATIONS

Alikin et al., "Porokha, topliva, zaryady. Zaryady narodhokhozyaystvennogo, naznacheniya (Gunpowdes, fuels, charges. Changes of economical purpose)," Moscow Chemistry, vol. 2, pp. 122-128 (2004).

*Primary Examiner* — Arthur O Hall
*Assistant Examiner* — Tuongminh Pham
(74) *Attorney, Agent, or Firm* — Muncy, Geissler, Olds & Lowe, P.C.

(57) ABSTRACT

A new method for extinguishing fire is provided, characterized in that a pyrotechnic agent is used as a heat source (energy) and a power source (driving gas); during use, the pyrotechnic agent is ignited, and the high temperature generated by the combustion of the pyrotechnic agent is utilized to make a fire extinguishing composition produce a large amount of fire extinguishing substance, which is sprayed out together with the pyrotechnic agent, so as to achieve the purpose of extinguishing a fire. As compared with conventional aerosol fire extinguishing systems, gas fire extinguishing systems and water-based fire extinguishing systems, the fire extinguishing method of the present invention is more efficient and safer.

2 Claims, 1 Drawing Sheet

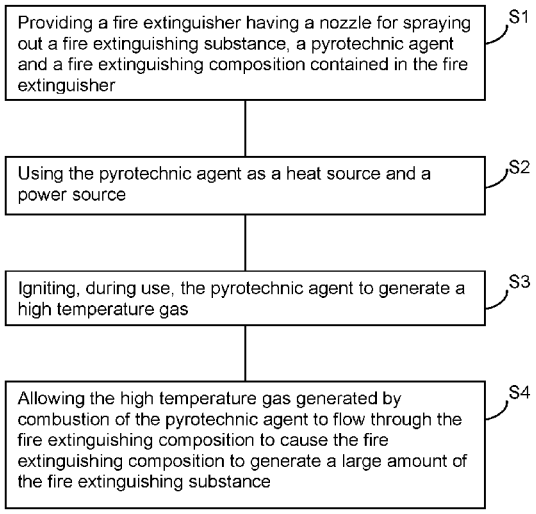

(58) Field of Classification Search
USPC ..... 169/9, 11–12, 26–28, 43–44, 84–85
See application file for complete search history.

(56) References Cited

U.S. PATENT DOCUMENTS

| | | | | |
|---|---|---|---|---|
| 5,423,385 | A * | 6/1995 | Baratov et al. | 169/46 |
| 5,609,210 | A * | 3/1997 | Galbraith et al. | 169/26 |
| 6,217,788 | B1 | 4/2001 | Wucherer et al. | |
| 6,513,602 | B1 * | 2/2003 | Lewis et al. | 169/84 |
| 2002/0121622 | A1 * | 9/2002 | Rusin et al. | 252/2 |
| 2005/0242319 | A1 * | 11/2005 | Posson et al. | 252/2 |

FOREIGN PATENT DOCUMENTS

| | | | |
|---|---|---|---|
| CN | 201260858 | Y | 6/2009 |
| CN | 101822883 | A | 9/2010 |
| RU | 2 170 601 | C1 | 7/2001 |

* cited by examiner

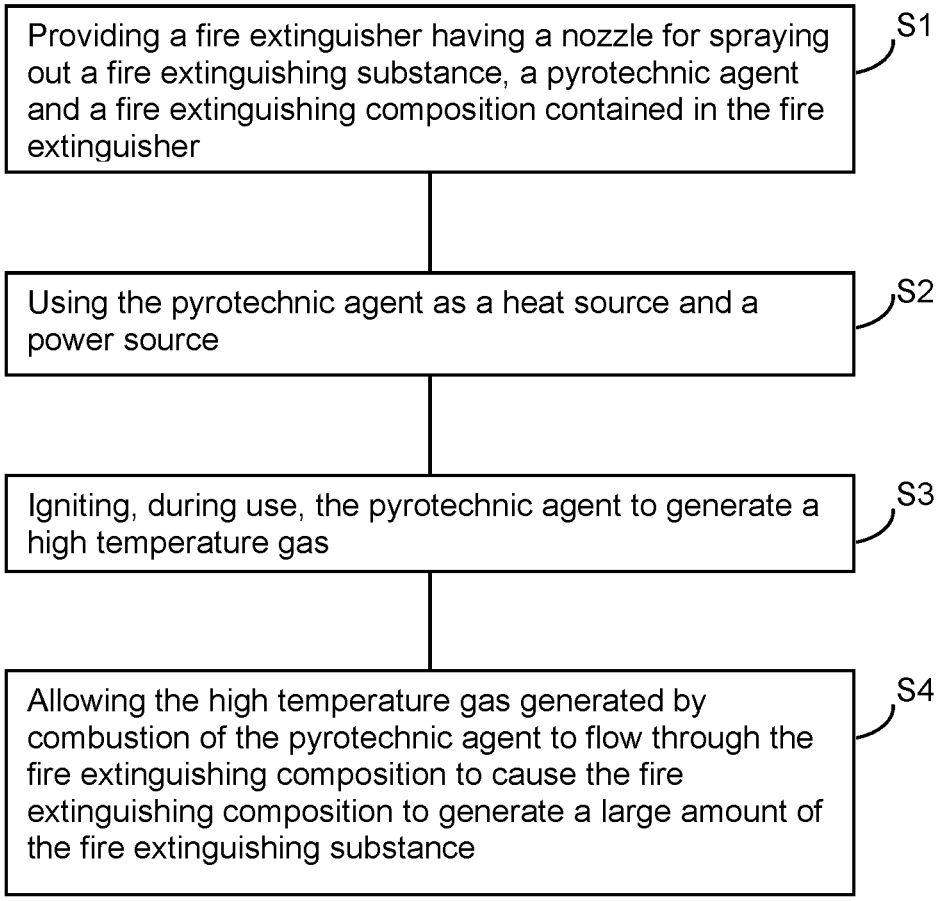
Providing a fire extinguisher having a nozzle for spraying out a fire extinguishing substance, a pyrotechnic agent and a fire extinguishing composition contained in the fire extinguisher
S1
Using the pyrotechnic agent as a heat source and a power source
S2
Igniting, during use, the pyrotechnic agent to generate a high temperature gas
S3
Allowing the high temperature gas generated by combustion of the pyrotechnic agent to flow through the fire extinguishing composition to cause the fire extinguishing composition to generate a large amount of the fire extinguishing substance
S4

METHOD FOR EXTINGUISHING FIRE

TECHNICAL FIELD

The invention belongs to the field of new fire extinguishing technology and relates to a new method for extinguishing fire.

BACKGROUND ART

Fires cause significant losses of people's lives and property. Existing fire extinguishing methods mainly include the follows. First, directly extinguish fire by making use of compressed gas, for example, gas fire extinguishers. Gases commonly used include carbon dioxide, IG541, etc. This fire extinguishing method has shortcomings such as inferior fire extinguishing efficiency, cumbersome device, and high cost for maintenance. Second, spray out fire extinguishing substance by compressed gas to extinguish fire, for example, pressurized dry powder fire extinguisher that sprays out the dry powder by using compressed gas to extinguish fire, a foam extinguisher that sprays out foam by using compressed gas to extinguish fire, heptafluoropropane extinguisher that sprays out heptafluoropropane by using compressed gas to extinguish fire. This fire extinguishing method also needs compressed gas, so there is a high requirement to the pressure resistance of the device, and the cost for maintenance is high as well. Third, extinguish fire by using pressurized water, for example, water spraying fire extinguisher that directly extinguish fire by using water flow or water spray. The drawback of this fire extinguishing method is that it has a poor extinguishing efficiency and cannot be used for extinguishing fire of electrical equipment. Fourth, extinguish fire by combusting a pulse agent to spray out fire extinguishing substance, for example, a pulse dry powder fire extinguisher that sprays out dry powder by using a large amount of gas generated instantly when the pyrotechnic agent combusts. This fire extinguishing method leads to a loud noise when spraying and is potentially hazardous to some extent. Fifth, extinguish fire by using the pyrotechnic agent to generate a fire extinguishing substance, for example, an aerosol fire extinguisher that extinguishes fire by using a large quantity of gas, water vapor and particles generated by the combustion of a pyrotechnic material. The drawback of this fire extinguishing method is that a large amount of heat is generated by the combustion of the pyrotechnic agent, and it may cause secondary combustion of the combustible if the fire extinguishing device is not provided with a cooling system, while a fire extinguishing device provided with a cooling system is cumbersome.

SUMMARY OF THE INVENTION

The present invention provides a novel fire extinguishing method different from the above-mentioned conventional fire extinguishing methods.

As we know, the essence of flame burning is a redox reaction occurring between an oxidant and a reducing agent. The flame itself is plasma composed of positive ions, negative ions, electrons, atoms, molecules, etc. Taking the combustion of hydrogen for example, the reaction mechanism is as follows:

$$H_2+O_2 \rightarrow 2OH. \quad (1)$$

$$H_2+OH. \rightarrow H.+H_2O \quad (2)$$

$$H.+O_2 \rightarrow OH.+O. \quad (3)$$

$$O.+H_2 \rightarrow OH.+H. \quad (4)$$

$$OH.+M \rightarrow MOH \quad (5)$$

$$H.+M \rightarrow M\ H \quad (6)$$

$$O.+M \rightarrow M\ O \quad (7)$$

Wherein formulae (1)-(4) are chain propagation processes, formulae (5)-(7) are chain termination processes, and M represents a substance annihilates radicals. Actual combustion process is even more complicated. No matter what kind of extinguishing method is adopted, the essence is to block the chain reaction of radicals and make the rate of generating radicals slower than the rate of annihilating the radicals.

The thought of the present invention is as follows: a fire extinguishing composition is composed of chemical substance that is apt to generate fire extinguishing substance while being heated, a processing aid and an adhesive (it is also possible not to add the processing aid or adhesive); a pyrotechnic agent or an aerosol generator is used as a heat source (energy) and a power source (driving gas) so that the fire extinguishing composition releases chemical substance that can block the chain reaction of the flame burning; the released fire-extinguishing chemical substance is utilized to extinguish fire.

According to the present invention, the chemical substance that is apt to generate fire extinguishing substance while being heated includes the following:

1) A compound or fire-extinguishing composition which, while being heated, is apt to decompose and release gas, liquid or solid particles that can extinguish fire.

Said compound includes carbonates, bicarbonates, subcarbonate of alkali metal and alkaline earth metal, a brominated flame retardant, a chlorinated flame retardant, organic phosphorus flame retardant, a phosphorus-halogenated flame retardant, a nitrogen flame retardant and phosphorus-nitrogen flame retardant, an inorganic flame retardant, and so on.

2) Elementary substance, compound or fire-extinguishing composition that, while being heated, is apt to sublimate to generate fire extinguishing substance.

Said elementary substance or compound includes iodine, ferrocene, ferrocene derivatives, halogenated aliphatic hydrocarbon and halogenated aromatic hydrocarbon having a melting point of 50° C. or higher, and so on.

3) Fire-extinguishing composition that undergoes a chemical reaction while being heated to generate a reaction product that can effectively extinguish fire.

The chemical reaction mentioned here refers to a chemical reaction that may occur between the component substances, and it is generally a redox reaction.

Said fire extinguishing composition includes a composition that can undergo a redox reaction, for example, a mixture of an oxidant such as potassium nitrate, sodium nitrate, etc., a reducing agent such as charcoal, a phenolic resin, etc., and noncombustible substance such as sodium chloride, potassium chloride, potassium carbonate, potassium bicarbonate, etc. When the composition is heated, a redox reaction can take place between the oxidant and the reducing agent, generating a fire extinguishing substance that extinguishes fire, but the composition itself does not combust. Accordingly, it is not equivalent to the aerosol generator in the conventional sense.

4) A novel composition composed of two or three of the above-mentioned groups of chemical substances.

In the present invention, the fire extinguishing composition can be made into spherical, cubic or irregular shape, preferably spherical shape.

In the present invention, the fire extinguishing composition can be solid or honeycomb, preferably honeycomb.

In the present invention, the fire extinguishing composition has a particle size of less than 20 mm, preferably 1-10 mm.

The fire extinguishing method of the present invention is advantageous in that it greatly improves the fire extinguishing efficiency as compared with the conventional aerosol fire extinguisher. Moreover, the fire extinguishing composition can significantly take away the heat generated by the combustion of pyrotechnic agent, so the fire extinguishing device has a lower temperature at the nozzle and therefore is safe to use.

BRIEF DESCRIPTION OF DRAWINGS

FIG. 1 is a flowchart illustrating a method for extinguishing fire according to an embodiment of the present application.

DESCRIPTION OF EMBODIMENTS

Example 1

40 mass % of zinc carbonate, 50 mass % of potassium carbonate and 10 mass % of microcrystalline paraffin wax are uniformly mixed. The mixture is made into pellets by a tabletting machine. Inside a fire extinguisher, a certain amount of said pellets are placed between the nozzle and a pyrotechnic agent, to form a simple and new type of fire extinguisher (Step S1 in FIG. 1).

The pyrotechnic agent is ignited (Steps S2 and S3 in FIG. 1), and the heat thus generated makes zinc carbonate decompose into zinc oxide and carbon dioxide that can extinguish fire. Gases generated during the combustion of the aerosol generator spray out the decomposition products through the nozzle (Step S4 in FIG. 1). The concentration-distribution fire-extinguishing test result is shown in Table 1.

Example 2

A certain amount of iodine are placed between the nozzle of the fire extinguisher and the pyrotechnic agent, to form a simple and new type of fire extinguisher.

The pyrotechnic agent is ignited, and the heat thus generated makes the iodine sublimate. Gases generated during the combustion of the aerosol generator spray out the sublimated substance. The concentration-distribution fire-extinguishing test result is shown in Table 1.

Example 3

10 mass % of potassium nitrate, 15 mass % of phenolic resin, 55 mass % of sodium chloride, 15 mass % of hydroxyl-terminated polybutadiene, 5 mass % of toluene diisocyanate are uniformly mixed. The mixture is poured to form prism honeycomb that is cured and processed into a bulk honeycomb. A certain amount of said bulk agent is placed between the nozzle of the fire extinguisher and the pyrotechnic agent, to form a simple and new type of fire extinguisher.

The pyrotechnic agent is ignited, and the heat thus generated makes potassium nitrate react with phenolic resin, hydroxyl-terminated polybutadiene and toluene diisocyanate, to generate substances such as carbon dioxide, nitrogen, potassium carbonate particles that can extinguish fire, etc. Gases generated during the combustion of the aerosol generator spray out the generated products. The concentration-distribution fire-extinguishing test result is shown in Table 1, Table 2 and Table 3.

TABLE 1

Assembly method and fire-extinguishing effects of the simple and new type of fire extinguishers
(Using an S-type aerosol generator as the power source and heat source)**

| Type/mass (g) of pyrotechnic agent | Type/mass (g) of fire-extinguishing chemical substance | Average fire-extinguishing number* | Highest temperature at nozzle (° C.) | Remarks |
|---|---|---|---|---|
| Commercially available S-type aerosol generator/50 | | 1.2 | 1250 | Comparative test |
| Commercially available S-type aerosol generator/50 | Fire-extinguishing compostion in Example 1/50 | 2.2 | 610 | |
| Commercially available S-type aerosol generator/50 | Fire-extinguishing elementary substance in Example 2/50 | 3.6 | 465 | |
| Commercially available S-type aerosol generator/50 | Fire-extinguishing compostion in Example 3/50 | 2.8 | 830 | |

*average value of five parallel tests

TABLE 2

Assembly method and fire-extinguishing effects of the simple and new type of fire extinguishers
(Using a K-type aerosol generator as the power source and heat source)**

| Type/mass (g) of pyrotechnic agent | Type/mass (g) of fire-extinguishing chemical substance | Average fire-extinguishing number* | Highest temperature at nozzle (° C.) | Remarks |
|---|---|---|---|---|
| Commercially available S-type aerosol generator/15 | | 2.6 | 790 | Comparative test |
| Commercially available K-type aerosol generator/15 | Fire-extinguishing compostion in Example 1/50 | 4.2 | 430 | |
| Commercially available K-type aerosol generator/15 | Fire-extinguishing elementary substance in Example 2/50 | 4.8 | 355 | |
| Commercially available K-type aerosol generator/15 | Fire-extinguishing compostion in Example 3/50 | 4.4 | 640 | |

*average value of five parellel tests

TABLE 3

| Assembly method and fire-extinguishing effects of the simple and new type of fire extinguishers (Using an aerosol generator as the power source and heat source)** | | | | |
|---|---|---|---|---|
| Type/mass (g) of pyrotechnic agent | Type/mass (a) of fire-extinguishing chemical substance | Average fire-extinguishing number* | Highest temperature at nozzle (° C.) | Remarks |
| Commercially available pyrotechnic agent/100 | | 0 | 960 | Comparative test |
| Commercially available K-type aerosol generator/100 | Fire-extinguishing compostion in Example 1/50 | 1.8 | 520 | |
| Commercially available K-type aerosol generator/100 | Fire-extinguishing elementary substance in Example 2/50 | 3.0 | 395 | |
| Commercially available K-type aerosol generator/100 | Fire-extinguishing compostion in Example 3/50 | 2.2 | 690 | |

*average value of five parellel tests
**Fire extinguishing model

A test model is made with reference to 7.13 Concentration-distribution test of Part 1—Thermal aerosol fire extinguishing device of the Aerosol Fire Extinguishing System (GA499.1-2004), and a test process according to this is adopted.

The test chamber is a cube having an inner side length of 1 m. With reference to the front door of the test chamber, one fuel tank having an inner diameter of 30 mm and a height of 100 mm is placed at each of the upper left front part, the upper right rear part, the lower left rear part, the lower right front part, and the back of baffle in the test chamber. The fuel used is n-heptane. Ignite n-heptane, allow it to pre-burn for 30 seconds, close the door of the test chamber, and start a simple and new type fire extinguisher to extinguish fire.

Open the test chamber 30 seconds later after the completion of the ejection of the fire extinguisher. Calculate an average fire-extinguishing number based on the fire-extinguishing number of five parallel tests.

The invention claimed is:

1. A method for extinguishing fire, the method comprising:

providing a fire extinguisher having a nozzle for spraying out a fire extinguishing substance, a pyrotechnic agent and a fire extinguishing composition contained in the fire extinguisher, the fire extinguishing composition being disposed between the nozzle and the pyrotechnic agent within the fire extinguisher;

using the pyrotechnic agent as a heat source and a power source;

igniting, during use, the pyrotechnic agent to generate a high temperature gas; and allowing the high temperature gas generated by combustion of the pyrotechnic agent to flow through the fire extinguishing composition to cause the fire extinguishing composition to generate a large amount of the fire extinguishing substance, which is sprayed out together with the pyrotechnic agent through the nozzle, so as to achieve a purpose of extinguishing a fire, wherein the fire extinguishing composition includes 40 mass % of zinc carbonate, 50 mass % of potassium carbonate, and 10 mass % of microcrystalline paraffin wax.

2. A method for extinguishing fire, the method comprising:

providing a fire extinguisher having a nozzle for spraying out a fire extinguishing substance, a pyrotechnic agent and a fire extinguishing composition contained in the fire extinguisher, the fire extinguishing composition being disposed between the nozzle and the pyrotechnic agent within the fire extinguisher;

using the pyrotechnic agent as a heat source and a power source;

igniting, during use, the pyrotechnic agent to generate a high temperature gas; and allowing the high temperature gas generated by combustion of the pyrotechnic agent to flow through the fire extinguishing composition to cause the fire extinguishing composition to generate a large amount of the fire extinguishing substance, which is sprayed out together with the pyrotechnic agent through the nozzle, so as to achieve a purpose of extinguishing a fire, wherein the fire extinguishing composition includes 10 mass % of potassium nitrate, 15 mass % of phenolic resin, 55 mass % of sodium chloride, 15 mass % of hydroxyl-terminated polybutadiene, and 5 mass % of toluene diisocyanate.

* * * * *